US010537134B1

(12) United States Patent
Xiao

(10) Patent No.: US 10,537,134 B1
(45) Date of Patent: Jan. 21, 2020

(54) PORTABLE ASPIRATION DEVICE

(71) Applicant: SHENZHEN UWELL TECHNOLOGY CO., LTD., Shenzhen (CN)

(72) Inventor: Yucheng Xiao, Shenzhen (CN)

(73) Assignee: SHENZHEN UWELL TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/247,602

(22) Filed: Jan. 15, 2019

(30) Foreign Application Priority Data

Dec. 5, 2018 (CN) ..... 2018 1 1480382

(51) Int. Cl.
*A24F 47/00* (2006.01)
*A24F 15/18* (2006.01)

(52) U.S. Cl.
CPC ..... *A24F 15/18* (2013.01); *A24F 47/002* (2013.01)

(58) Field of Classification Search
CPC ..... A24F 47/002; A24F 47/008; A24F 15/02; A24F 15/08; A24F 15/12; A24F 15/18
USPC ..... 368/281, 294; 131/329
See application file for complete search history.

(56) References Cited

U.S. PATENT DOCUMENTS 9,004,329 B2 * 4/2015 Hsieh ..... G04G 17/08 224/169
9,737,123 B2 * 8/2017 Wright ..... A45C 13/008
10,111,467 B1 * 10/2018 Arnel ..... H05B 1/0227
2006/0171261 A1 * 8/2006 Ruchonnet ..... G04B 37/00 368/281
2007/0253290 A1 * 11/2007 Aire ..... G04B 3/045 368/294
2012/0134244 A1 * 5/2012 Margaritelli ..... G04B 47/046 368/281
2015/0264978 A1 * 9/2015 Arnel ..... A24F 47/002 131/329
2016/0058074 A1 * 3/2016 Liu ..... A24F 47/008 131/329
2017/0099916 A1 * 4/2017 Burr ..... A44C 1/00
2017/0231283 A1 * 8/2017 Gadas ..... A24F 7/02 131/329

* cited by examiner

*Primary Examiner* — Corey N Skurdal

(57) ABSTRACT

A portable aspiration device includes an aspiration member and a bracelet member. The bracelet member includes a wristband, a base, and a locking structure. The base includes a receiving room for receiving the aspiration member and an accommodating room in communication with the receiving room. The wristband is fixed to the base and sleeve on a hand bowl to conveniently carry the aspiration member. The locking structure is accommodated in the accommodating room to lock the aspiration member, and includes a locking portion, a resetting portion, and a switching portion. The locking portion is inserted into the socket to lock the aspiration member in the base. The switching portion is pressed to drive the locking portion to disengage from the socket so that the aspiration member may be taken out from the base. The resetting portion is adapted to reset the locking portion and the switching portion.

10 Claims, 9 Drawing Sheets

PORTABLE ASPIRATION DEVICE

BACKGROUND

1. Technical Field

The present invention relates to aspiration devices, in particular to relates to a portable aspiration device.

2. Description of Related Art

The present aspiration devices on the market are directly held by hand, or put in bags, or in pockets. It is very inconvenient to carry or use, and very easy to lose.

SUMMARY

In order to overcome the above problems, the purpose of the present invention is to provide a portable aspiration device that is easy to carry and use.

The technical solution adopted for solving technical problems of the present disclosure is:

A portable aspiration device includes an aspiration member and a bracelet member. The bracelet member includes a wristband, a base, and a locking structure. The base includes a receiving room for receiving the aspiration member and an accommodating room in communication with the receiving room. The wristband is fixed to the base and sleeve on a hand bowl to conveniently carry the aspiration member. The locking structure is accommodated in the accommodating room to lock the aspiration member, and includes a locking portion, a resetting portion, and a switching portion. The locking portion is inserted into the socket to lock the aspiration member in the base. The switching portion is pressed to drive the locking portion to disengage from the socket so that the aspiration member may be taken out from the base. The resetting portion is adapted to reset the locking portion and the switching portion.

Wherein the locking portion comprises a locking element comprising a locking end and an accommodating end opposite to the locking end, and a fixing housing defining a locating groove, wherein the locking end is inserted into the socket to lock the aspiration member, and the accommodating end is partly received in the locating groove.

Wherein the accommodating end defines an accommodating groove, the fixing housing comprises a first locating post and a first locating hole in communication with the locating groove, and the resetting portion comprises a first elastic element, wherein one end of the first elastic element is coiled around the first locating post, and another end of the first elastic element is received in the accommodating groove of the accommodating end through the first locating hole.

Wherein the fixing housing comprises a second locating post and a second locating hole in communication with the locating groove, and the resetting portion comprises a second elastic element, wherein one end of the second elastic element is coiled around the second locating post, and another end of the second elastic element is received in the switching portion through the second locating hole.

Wherein the switching portion comprises a button element comprising a button post and a receiving post, and a sliding pole comprising a hemisphere partially received in the receiving post, wherein the sliding pole is driven to move by pressing the button post, and the sliding pole drives the locking element to move, thereby realizing the aspiration member in an unlocking state.

Wherein the locking element comprises a pair of first slanting parts, and the sliding pole comprises a pair of second slanting parts, wherein the second slanting parts is driven to move by pressing the button post, the second slanting parts drives the first slanting parts to move so that the locking portion disengages from the socket, and the aspiration member may be taken out from the base.

Wherein the sliding pole comprises a sliding body and a receiving groove between the pair of second slanting parts, and the locking element comprises a locking body partly received in the receiving groove, wherein the first slanting parts extend from the accommodating end to the locking end.

Wherein the base comprises a waterproof seal ring fixed in inner wall of the receiving room, wherein when the aspiration member is received in the receiving room, the waterproof seal ring is in a compression state, when the aspiration member is disengaged from the receiving room, the waterproof seal ring is in a free state, during the aspiration member being disengaged from the receiving room, the waterproof seal ring provides resilience force to release the aspiration member from a locking state.

Wherein the locking body defines a pair of guiding grooves extending from the accommodating end to the locking end, the fixing housing comprises a pair of guiding blocks projecting from inner walls of the locating groove, wherein the guiding blocks may move along the guiding grooves respectively.

Wherein the locking structure comprises a fixing portion comprising a pair of fixing posts, the base defines a pair of fixing holes for receiving the fixing posts to fix the locking structure in the base.

The present disclosure provides the advantages as below.

The structure of the present disclosure is provided that aspiration member 10 is directly sleeved on the hand bowl of the user by the bracelet member. When used, the aspiration member can be directly used as an electronic cigarette by removing the aspiration member from the bracelet member. When in not use, the aspiration member is directly installed in the bracelet member, which greatly improves the convenience of use and carrying, and solves the problem of the conventional aspiration device because it needs to be put in a backpack or pocket or held directly by hand.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
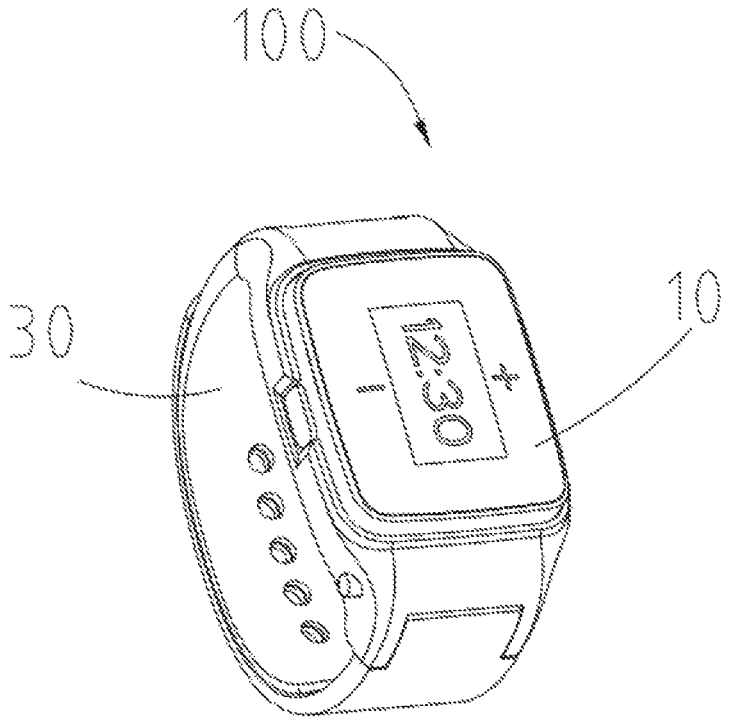
FIG. 1 is an assembled view of an aspiration device of an exemplary embodiment of the present invention, the portable aspiration device including an aspiration member and a bracelet member.

The disclosure is illustrated by way of example and not by way of limitation in the figures of the accompanying drawings, in which like reference numerals indicate similar elements. According to the described exemplary embodiment of the present disclosure, all other embodiments obtained by one of ordinary skill in the related art without the need for creative labor are within the protection scope of the present disclosure. Unless defined otherwise, the technical terms or scientific terms used for the present disclosure shall be a general meaning commonly understood by those having ordinary skill in the related art to which the present disclosure is applied.

In the description of the present disclosure, it needs to be understood that the terms mentioned below: "central", "longitudinal", "transverse", "length", "width", "thickness", "upper", "below", "front", "back", "left", "right", "vertical", "horizontal", "top", "bottom", "inner", "outer", "clockwise", "anticlockwise", etc, are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

In addition, the terms such as "first" and "second" shown in the specification are only used to describe, but not indicated that the elements of the present disclosure is important or represented the amount of the elements. That is, the features limited by the terms of "first" and "second" may explicitly or implicitly include one or more features. In the description of the present disclosure, the meaning of the term "a plurality of" is not less than two unless it is specifically illustrated.

In the present disclosure, except where specifically otherwise illustrated or limited, the terms "install", "connect", "link" and "fix" used herein should be understood in a broad perceive. Such as, the meaning may be a tight connection, removable connection, or integrated connection. The meaning may also be mechanical connection, electrical connection, direct connection or indirect connection through intermediaries, or internal connection within two elements. The meaning of the terms used herein may be understood by one of ordinary skill in the related art according to specific conditions of the present disclosure.

Referring to FIG. 1, the aspiration device 100 in accordance with an exemplary embodiment of the present disclosure includes an aspiration member 10 and a bracelet member 30.

Referring to FIG. 1 to FIG. 4, the bracelet member 30 includes wristband 32, a base 34, and a locking structure 40. The base 34 defines a receiving room 340 for receiving the aspiration member 10 and an accommodating room 342 in communication with the receiving room 340. The wristband 32 is fixed to the base 34 so that the wristband 32 together with the aspiration member 10 sleeves on a hand bowl of a user, thereby conveniently carrying the aspiration member 10. The locking structure 40 is accommodated in the accommodating room 342 to lock the aspiration member 10. The locking structure 40 includes a locking portion 42, a resetting portion 44, and a switching portion 48. The aspiration member 10 defines a socket 16, and the locking portion 42 is inserted into the socket 16 to lock the aspiration member 10 in the base 34. The switching portion 48 is pressed to drive the locking portion 42 to disengage from the socket 16 so that the aspiration member 10 may be taken out from the base 34. The resetting portion 44 is adapted to reset the locking portion 42 and the switching portion 48.

In the embodiment, the socket 16 is a USB interface. That is to say, the socket 16 of the aspiration member 10 has a double function.

The aspiration member 10 is directly sleeved on the hand bowl of the user. When used, the aspiration member 10 can be directly used as an electronic cigarette by removing the aspiration member 10 from the bracelet member 30. When in not use, the aspiration member 10 is directly installed in the bracelet member 30, which greatly improves the convenience of use and carrying, and solves the problem of the conventional aspiration device because it needs to be put in a backpack or pocket or held directly by hand.

Furthermore, the aspiration member 10 is adapted to display a date and time. When the aspiration member 10 is not the electronic cigarette, the portable aspiration device 100 of the present invention can be used as a clock. That is to say, the portable aspiration device 100 of the present invention integrates aspiration function and clock function, further improving the convenience of use.

The aspiration member 10 further includes a function key 14, which calls out a corresponding interface, to adjust the date and time by touching touch points 12 on a display screen of the aspiration member 10, and confirm the date and time by pressing the function key 14.

Figure 2:
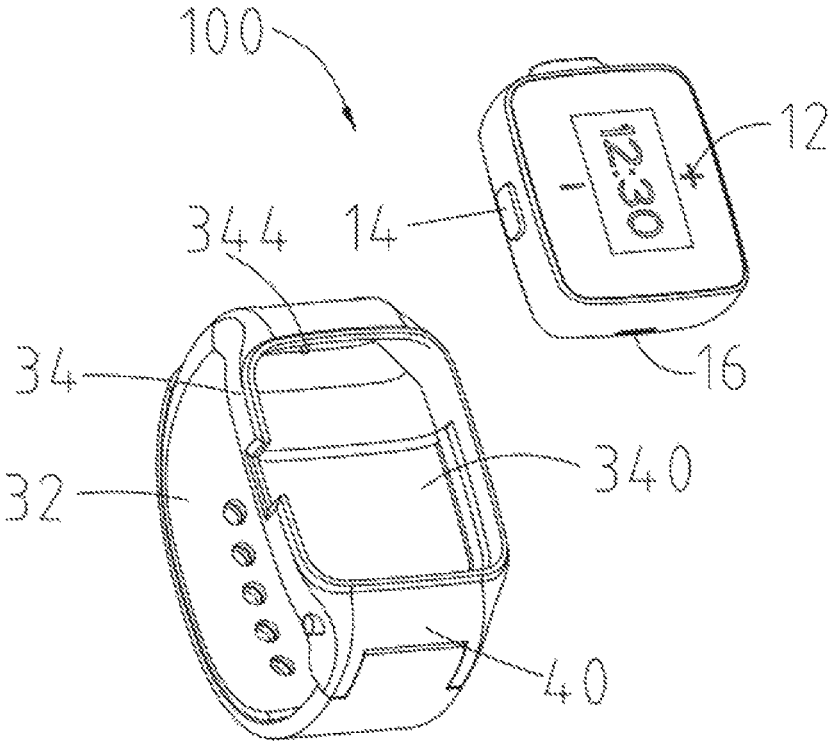
FIG. 2 is an exploded view of FIG. 1.

Referring to FIG. 2, the base 34 defines a draining hole 344 to drain water or liquid mistakenly inserted into base 34, so that the water or liquid cannot enter the aspiration member 10.

Referring to FIG. 3 to FIG. 16, the locking portion 42 includes a locking element 41 and a fixing housing 43. The locking element 41 includes a locking end 411 and an accommodating end 413 opposite to the locking end 411. The fixing housing 43 defines a locating groove 432. The locking end 411 is inserted into the socket 16 to lock the aspiration member 10, and the accommodating end 413 is partly received in the locating groove 432.

In one embodiment, the locking end 411 is an arc inclined plane, which facilitates the locking end 411 to be inserted into the socket 16.

Figure 3:
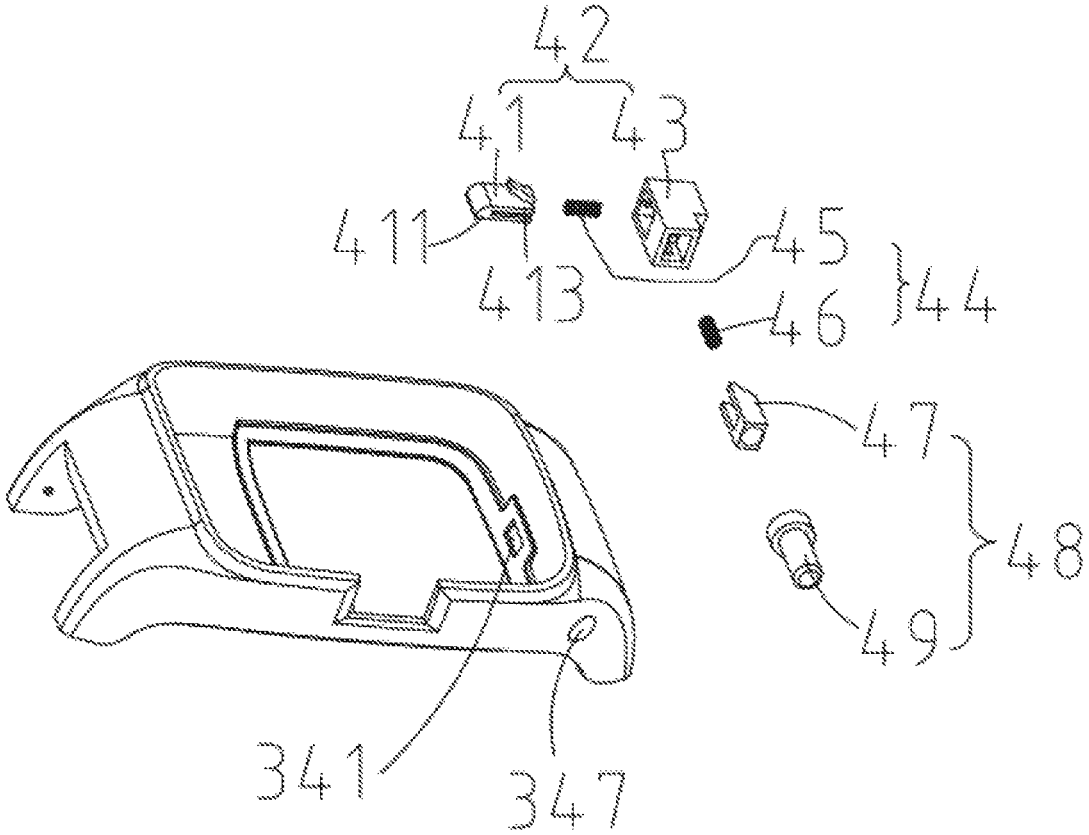
FIG. 3 is an exploded view of a base and a locking structure of FIG. 2.

Referring to FIG. 3, the base 34 defines a passageway 341, and the locking end 411 is inserted into or disengaged from the socket 16 through the passageway 341 to lock or unlock the aspiration member 10.

Referring to FIGS. 3-4, FIG. 11, and FIG. 16, the accommodating end 413 defines an accommodating groove 418. The fixing housing 43 includes a first locating post 433 and a first locating hole 431 in communication with the locating groove 432. The resetting portion 44 includes a first elastic element 45. One end of the first elastic element 45 is coiled around the first locating post 433, and another end of the first elastic element 45 is received in the accommodating groove 418 of the accommodating end 413 through the first locating hole 431.

Figure 4:
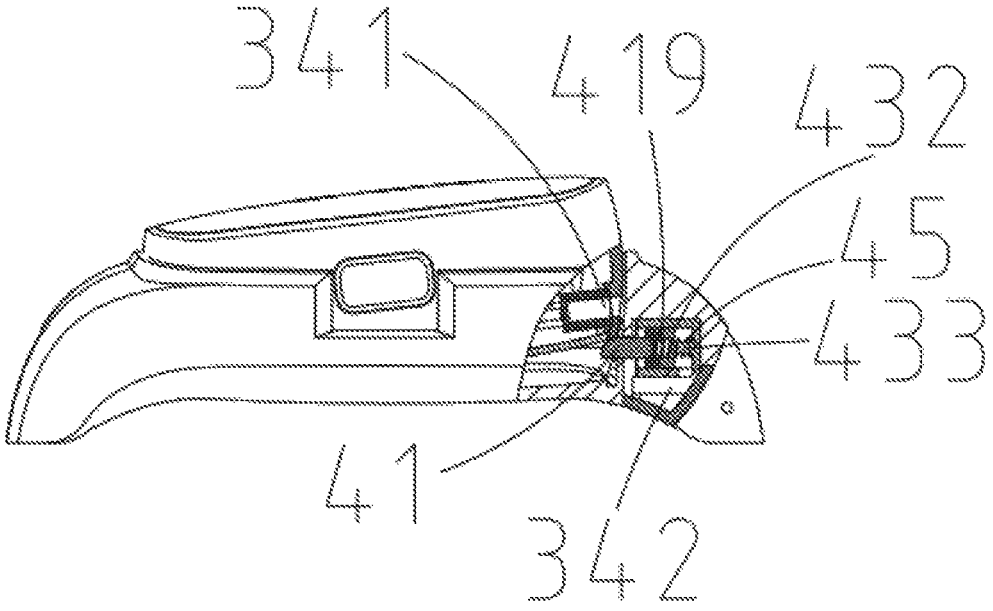
FIG. 4 is a partially cross-sectional view of FIG. 1, showing the portable aspiration device in an unlocking state.
Figure 5:
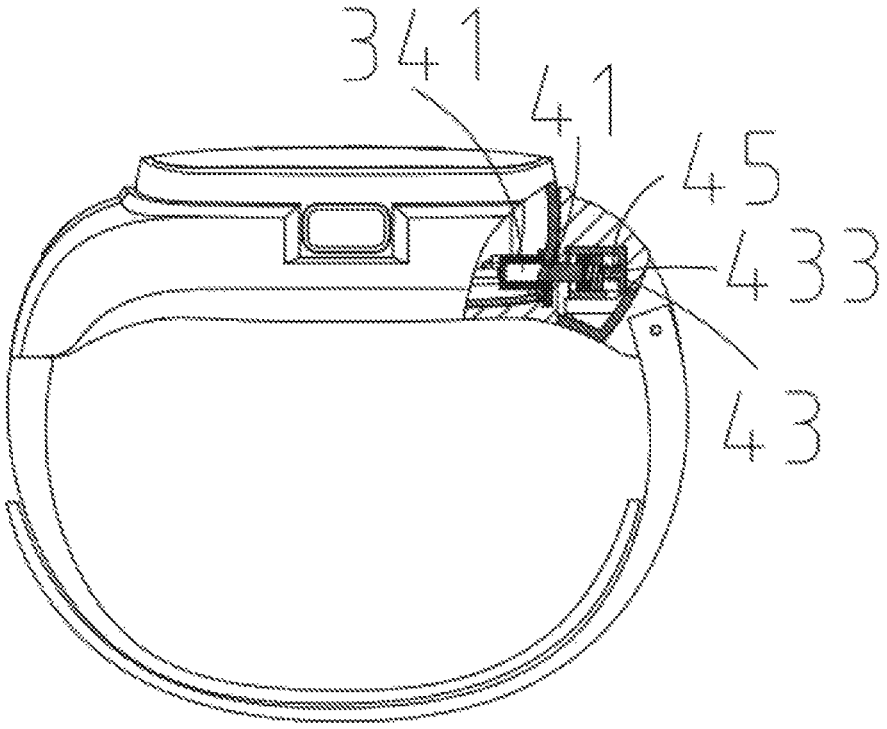
FIG. 5 is similar to FIG. 4, but showing the portable aspiration device in a locking state.
Figure 6:
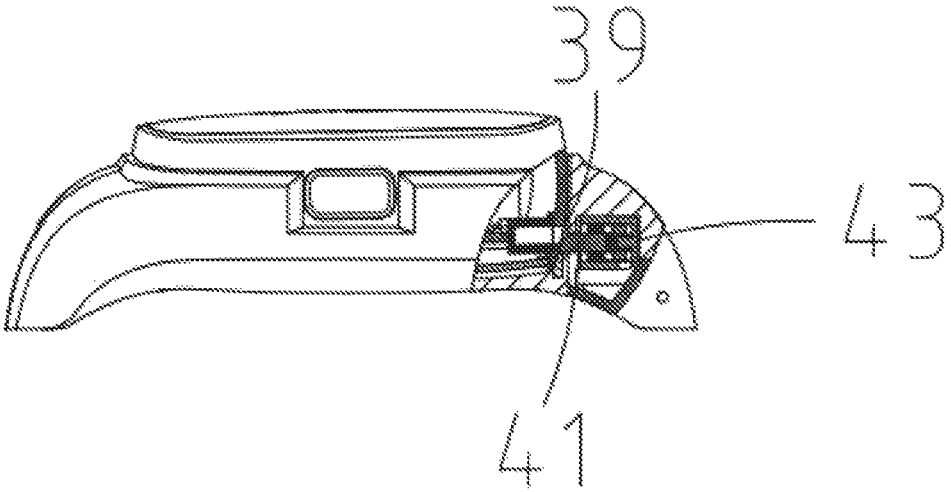
FIG. 6 is similar to FIG. 4, but showing the portable aspiration device from the locking state to the unlocking state.
Figure 7:
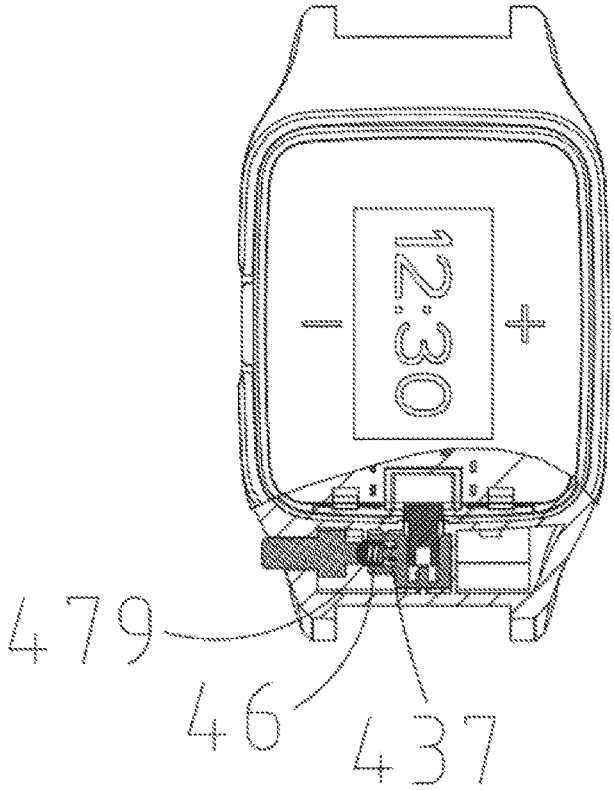
FIG. 7 is similar to FIG. 5, viewed from another aspect.
Figure 12:
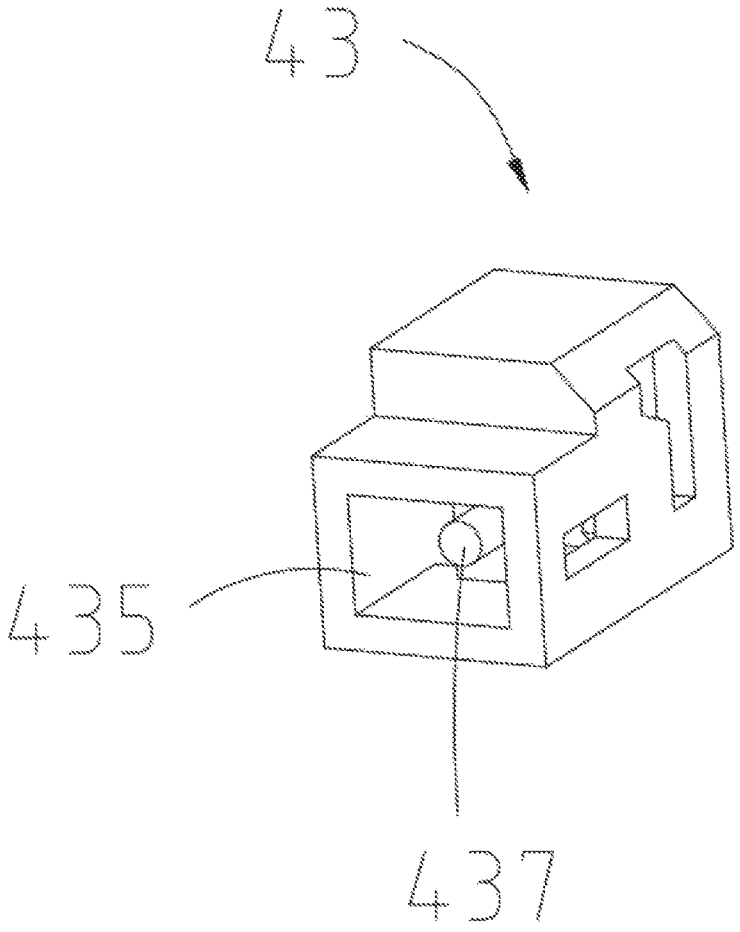
FIG. 12 is similar to FIG. 11, viewed from another aspect.
Figure 13:
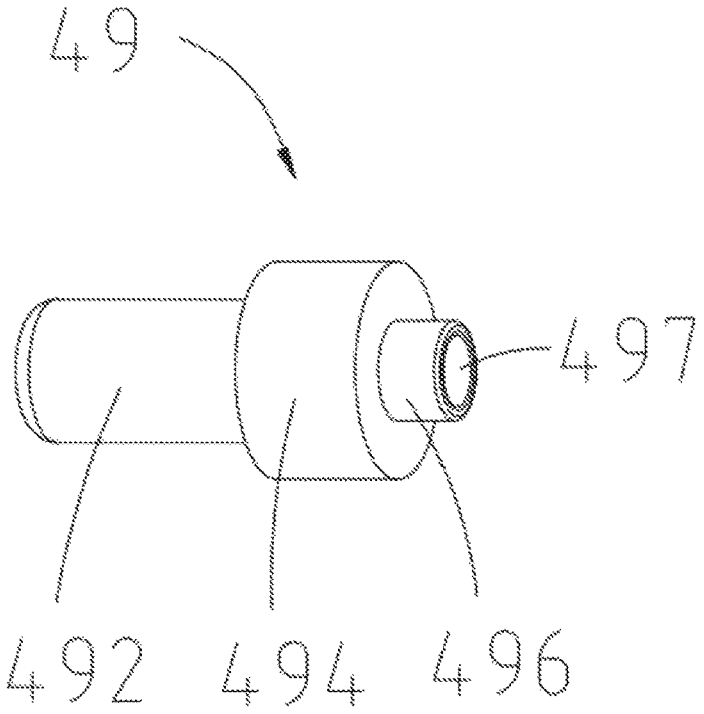
FIG. 13 is an enlarged isometric view of a locking element of FIG. 2.

Referring to FIGS. 3-4, and FIG. 12, the fixing housing 43 includes a second locating post 437 and a second locating hole 435 in communication with the locating groove 432. The resetting portion 44 includes a second elastic element 46. One end of the second elastic element 46 is coiled around the second locating post 437, and another end of the second elastic element 46 is received in the switching portion 48 through the second locating hole 435.

Referring to FIG. 1, FIG. 3, FIG. 13, and FIG. 14, the switching portion 48 includes a button element 49 includes a button post 492 and a receiving post 496, and a sliding pole 47 including a hemisphere 477 partially received in the receiving post 496. The sliding pole 47 is driven to move by pressing the button post 492, and the sliding pole 47 drives the locking element 41 to move, thereby realizing the aspiration member 10 in an unlocking state.

Referring to FIG. 1, FIG. 3, FIG. 13, and FIG. 14, the base 34 defines a sliding groove 347. The button element 49 slides along the sliding groove 347 to drive the sliding pole 47 to move, and the sliding pole 47 drives the locking element 41 to move, thereby realizing the aspiration member 10 in the unlocking state.

In one embodiment, the receiving post 496 defines a recess 497, and the hemisphere 477 is partially received in the recess 497.

In one embodiment, the button element 49 further includes a connecting post 494 between the button post 492 and the receiving post 496. A diameter of the connecting post 494 is greater than that of the button post 492, and a diameter of the connecting post 494 is greater than that of the receiving post 496.

Referring to FIGS. 1-2, FIG. 13, FIG. 14-15, and FIG. 16, the locking element 41 includes a pair of first slanting parts 412, and the sliding pole 47 includes a pair of second slanting parts 472. The second slanting parts 472 is driven to move by pressing the button post 49, the second slanting parts 472 drives the first slanting parts 412 to move so that the locking portion 41 disengages from the socket 16, and the aspiration member 10 may be taken out from the base 34.

Referring to FIG. 3, FIGS. 14-15, and FIG. 16, the sliding pole 47 includes a sliding body 476 and a receiving groove 474 between the pair of second slanting parts 472. The locking element 41 includes a locking body 416 partially received in the receiving groove 474. The first slanting parts 412 extend from the accommodating end 413 to the locking end 411.

Figure 14:
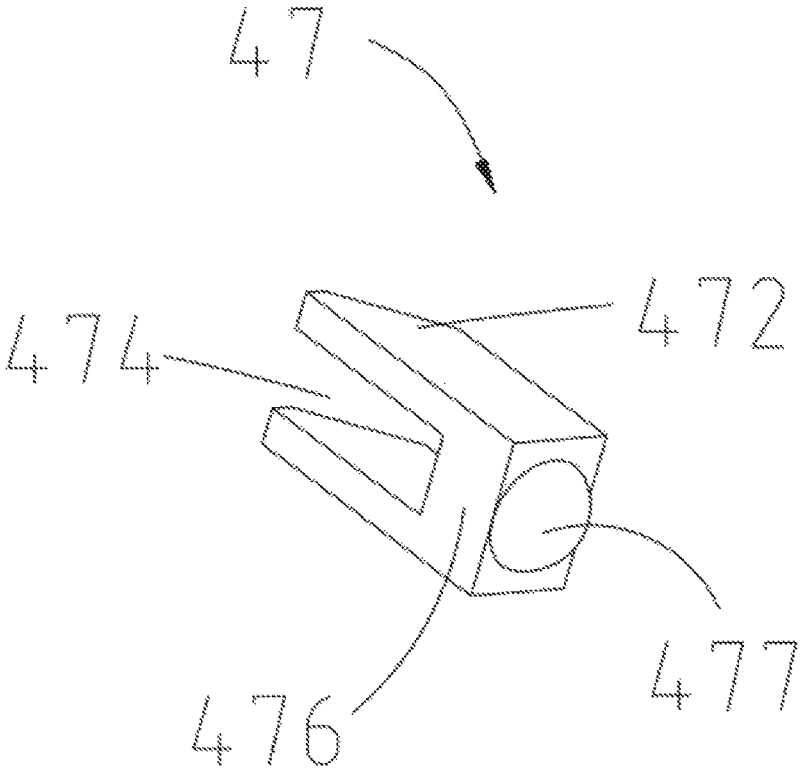
FIG. 14 is an enlarged isometric view of a sliding pole of FIG. 2.
Figure 15:
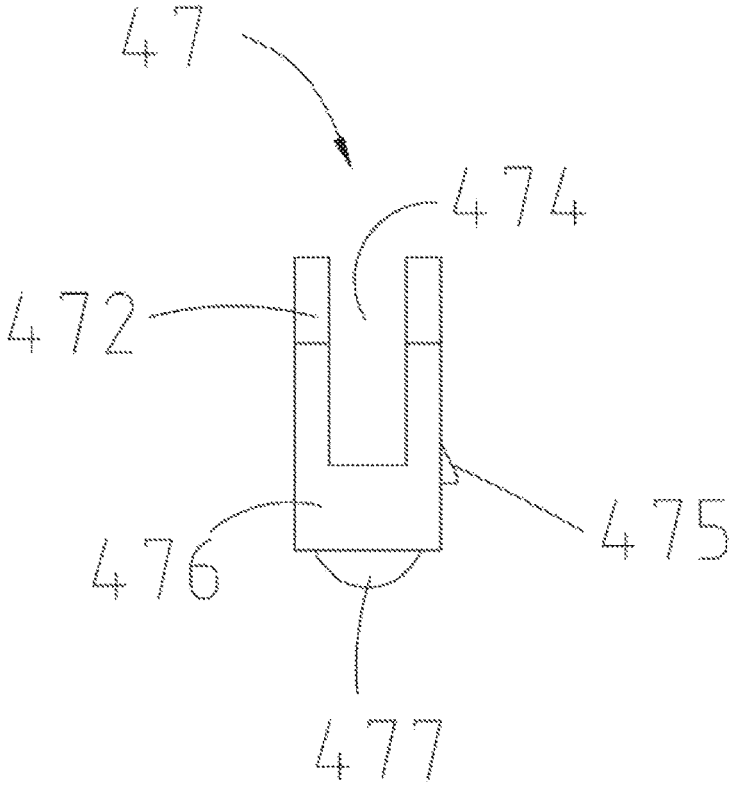
FIG. 15 is a plan view of the sliding pole of FIG. 2.
Figure 16:
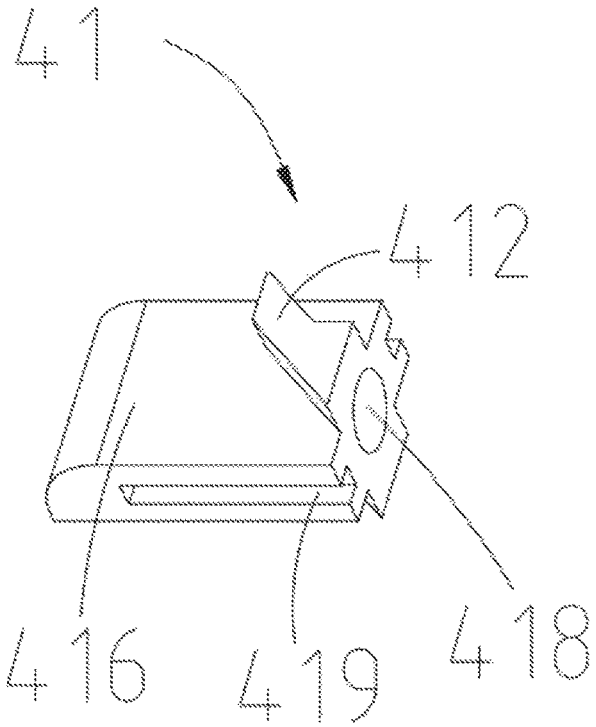
FIG. 16 is an enlarged isometric view of locking element of FIG. 2.

Referring to FIGS. 14-15, the sliding pole 47 includes a block 475 projecting from a bottom surface of the sliding body 476 to prevent the transition motion of the sliding pole 47 under the resilience force of the second elastic element 46. The hemisphere 477 is located at an end of the sliding body 476.

Figure 8:
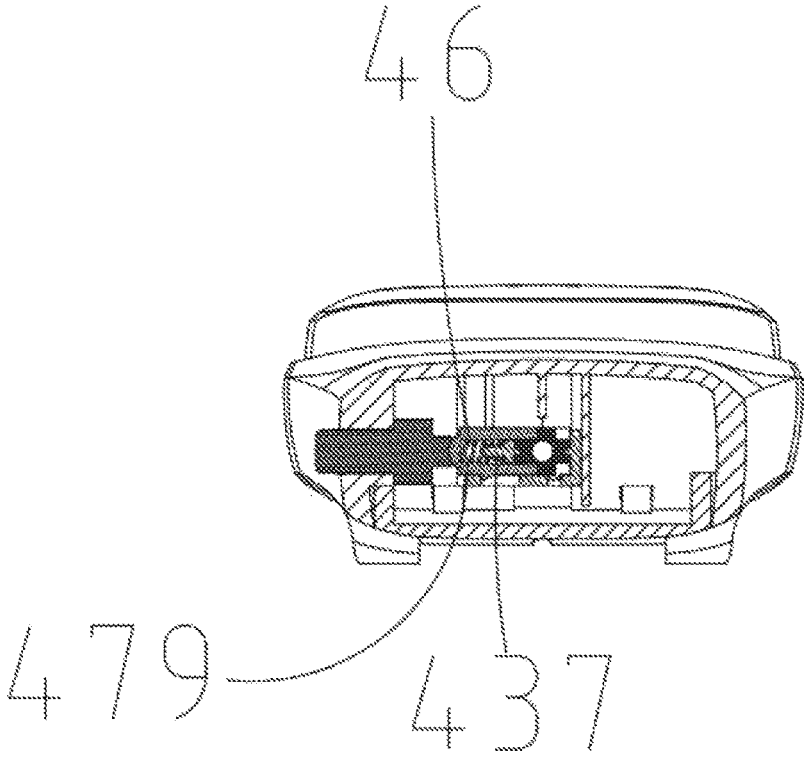
FIG. 8 is similar to FIG. 5, viewed from another aspect.
Figure 9:
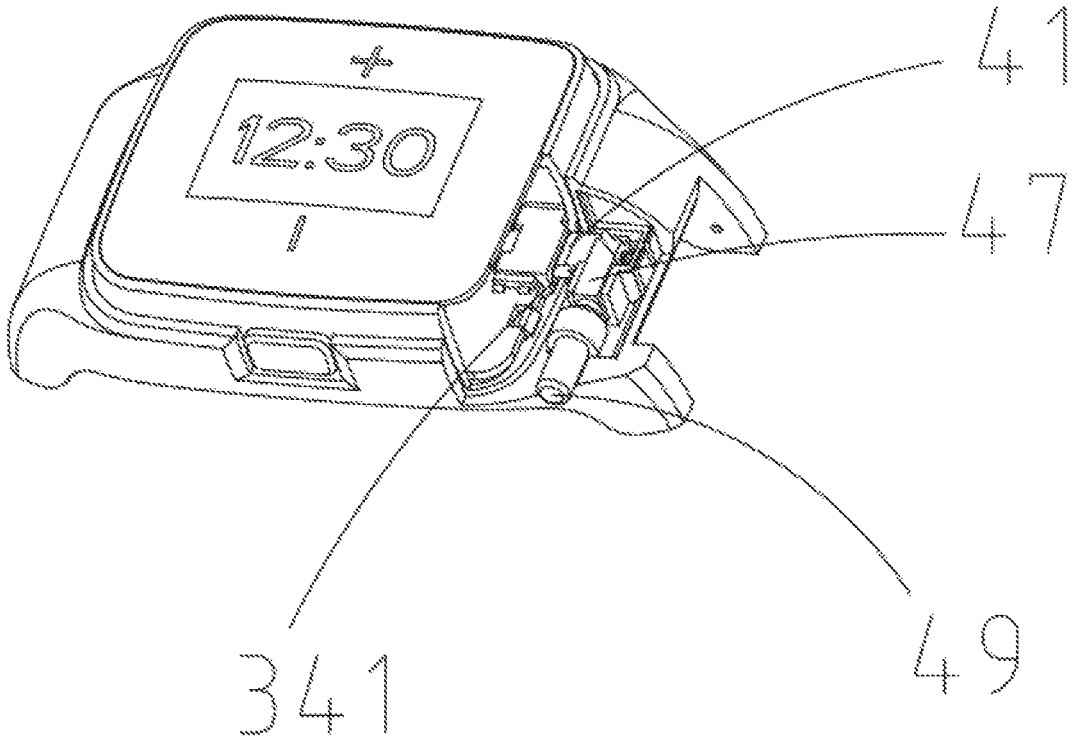
FIG. 9 is partially assembled view of FIG. 1, showing the portable aspiration device in the locking state.
Figure 10:
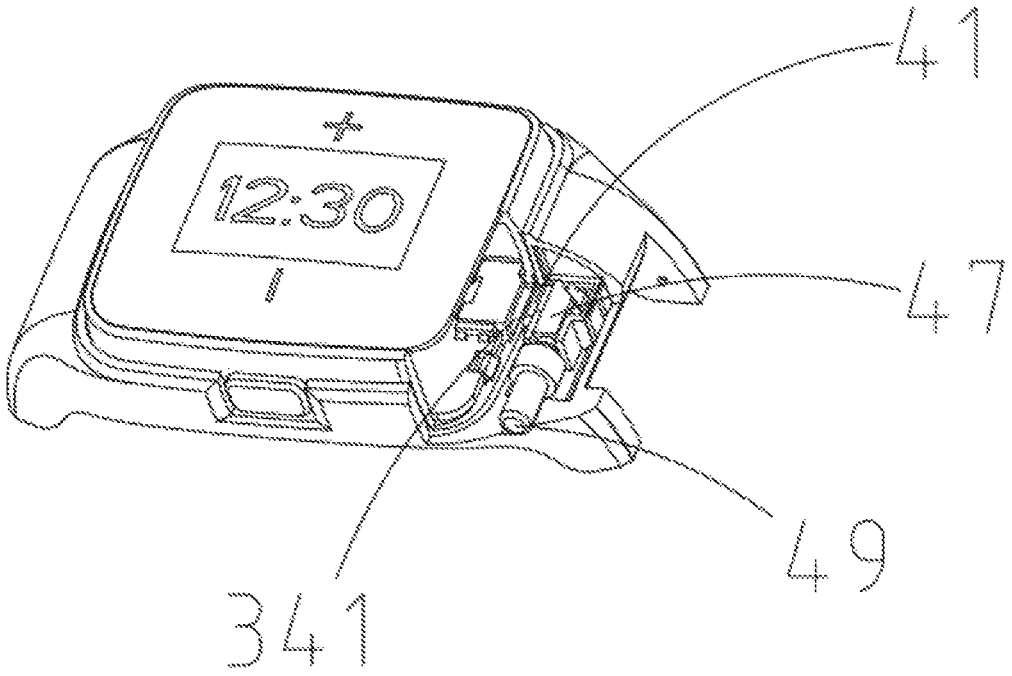
FIG. 10 is similar to FIG. 9, but showing the portable aspiration device in the unlocking state.
Figure 11:
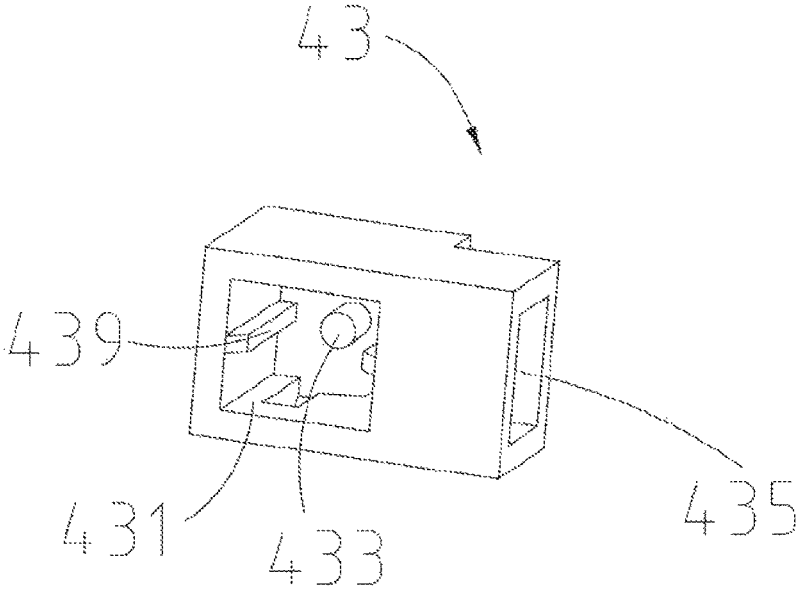
FIG. 11 is an enlarged isometric view of a fixing housing of FIG. 2.

Referring to FIG. 8 and FIGS. 14-15, the sliding body 476 defines a receiving hole 479 in communication with the receiving groove 474, and another end of the second elastic element 46 is receiving hole 479.

Figure 17:
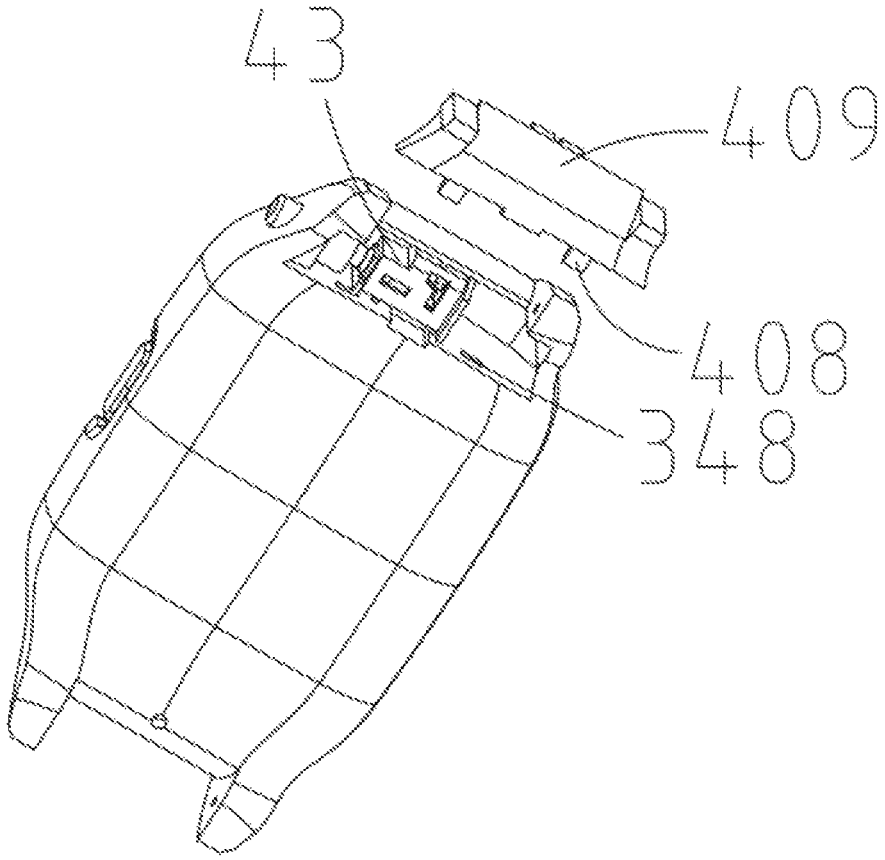
FIG. 17 is an exploded view of a base and a fixing portion of FIG. 1.
Figure 18:
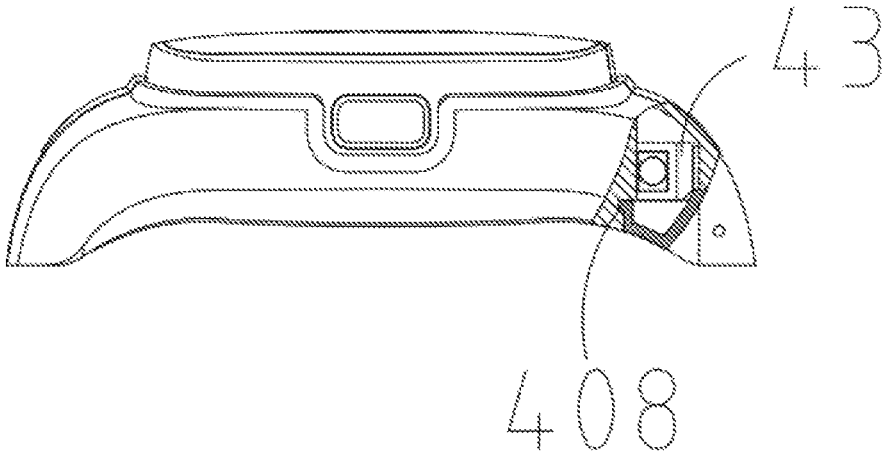
FIG. 18 is a partially cross-sectional view of FIG. 1, showing the fixing portion fixing the aspiration member in the base.

Referring to FIG. 2 and FIG. 17, the locking structure 40 includes a fixing portion 409 including a pair of fixing posts 408. The base 34 defines a pair of fixing holes 348 for receiving the fixing posts 408 to fix the locking structure 40 in the base 34.

Referring to FIGS. 3-4, FIG. 11 and FIG. 16, the locking element 41 defines a pair of guiding grooves 419 extending from the accommodating end 413 to the locking end 411. The fixing housing 43 includes a pair of guiding blocks 439 projecting from inner walls of the locating groove 432. The guiding blocks 439 may move along the guiding grooves 419 respectively, thus the movement direction of the locking element 41 is not offset.

Referring to FIGS. 3-4, and FIG. 11 to FIG. 17, the fixing housing 43 is received in the accommodating room 342. One end the first elastic element 45 is coiled around the first locating post 433. The locking end 411 of the locking element 41 slides along the passageway 341 of the base 34. Another end of the first elastic element 45 is received in the accommodating groove 418 of the locking element 41, and the guiding blocks 439 of the fixing housing 43 is received in the guiding grooves 419 of the locking element 41. One end of the second elastic element 46 is coiled around the second locating post 437. The button post 492 slides along the sliding groove 347. The hemisphere 477 is received in the recess 497 of the receiving post 496. Another end of the second elastic element 46 is received in the receiving hole 479. The locking body 416 is partially received in the receiving groove 474. The first slanting parts 412 is adjacent to the second slanting parts 472. The fixing posts 408 is received in the fixing holes 348 to fix the locking structure 40 in the base 34.

In one embodiment, the first elastic element 45 and the second elastic element 46 are springs.

Referring to FIGS. 3-6, the base 34 includes a waterproof seal ring 39 fixed in the inner wall of the receiving room 340. When the aspiration member 10 is received in the receiving room 340, the waterproof seal ring 39 is in a compression state, when the aspiration member 10 is disengaged from the receiving room 340, the waterproof seal ring 39 is in a free state, during the aspiration member 10 being disengaged from the receiving room 340, the waterproof seal ring 39 provides resilience force to release the aspiration member 10 from the locking state.

Referring to FIG. 1 to FIG. 18, in assembly, the touch points 12 of the display screen is up, and a cigarette holder of the aspiration member 10 is inserted into a cigarette holder hole of the base 34. The aspiration member 10 is pressed, and when the pressure on the locking end 411 is greater than the elastic force of the first elastic element 45, the locking element 41 move to the fixing housing 43. The aspiration member 10 is pressed continually until the locking end 411 abuts against the socket 16 of the aspiration member 10, subsequently the locking end 411 is inserted into the socket 16 under the resilience force of the first elastic element 45, thereby the aspiration member 10 being fixed in the base 34 by the locking element 41, and being not accidentally disengaged from the base 34, herein the aspiration member 10 is in the lock state. In disassembly, the button post 49 is pressed, when the pressure on the button post 49 is greater than the elastic force of the second elastic element 46, the button post 49 dives the second slanting parts 472 of the sliding pole 47 to move, and the second slanting parts 472 drives the first slanting parts 412 to move until the locking element 41 overcomes the elastic force of the first elastic element 45 and moves to the fixing housing 43, subsequently the locking end 411 of the locking element 41 disengage from the socket 16 of the aspiration member 10, the aspiration member 10 moves up under the elastic force of the waterproof seal ring 39, thus the aspiration member 10 is disengaged from the base 34, herein the aspiration member 10 is in the unlocked state. In the unlock state, the aspiration member 10 can be directly taken of the base 34 to use.

When the aspiration member 10 need not be used as the electronic cigarette, the aspiration member 10 is put into the receiving room 340 and is pressed until the aspiration member 10 is fixed in the base 34 of the bracelet member 30 (referring to FIG. 1). During pressing the aspiration member 10, the pressure on the locking element 41 is greater than the elastic force of the first elastic element 45, the locking element 41 moves to the fixing housing 43 until the locking end 411 abuts against the socket 16, subsequently the locking end 411 is inserted into the socket 16 under the resilience force of the first elastic element 45, and the first elastic element 45 moves from a compression state to an initial state of the initial assembly, herein the aspiration member 10 is in the lock state. In the lock state, the waterproof seal ring 39 is compressed, the first elastic element 45 is in the initial state of the initial assembly, and the second elastic element 46 is in an initial state of the initial assembly. When the aspiration member 10 need to be taken out, the button post 49 is pressed, and when the pressure on the button post 49 is greater than the elastic force of the second elastic element 46, the button post 49 dives the second slanting parts 472 of the sliding pole 47 to move, and the second slanting parts 472 drives the first slanting parts 412 to move until the locking element 41 overcomes the elastic force of the first elastic element 45 and moves to the fixing housing 43, subsequently the locking end 411 of the locking element 41 disengage from the socket 16 of the aspiration member 10, the aspiration member 10 moves up under the elastic force of the waterproof seal ring 39, herein the aspiration member 10 is in the unlock state, so that the aspiration member 10 can be directly taken of the base 34 to be used as the electronic cigarette. In the unlock state, the waterproof seal ring 39 is in the free state, and is not compressed, herein the waterproof seal ring 39 has no elastic force. During the aspiration member 10 from the lock state to the unlock state, the first elastic element 45 and the second elastic element 46 are first compressed and then reset to the initial state of the initial assembly. During the first elastic element 45 from the compression state to the initial state of the initial assembly, the locking element 41 first moves to the fixing housing 43 and then moves back the fixing housing 43 until the locking end 411 extends through the passageway 341. During the second elastic element 46 from the compression state to the initial state of the initial assembly, the button element 49 first moves to the fixing housing 43 and then moves back the fixing housing 43 until the button post 492 extends through the sliding groove 347.

When the aspiration member 10 is not used as the electronic cigarette, the aspiration member 10 is fixed in the base 34 of the bracelet member 30 without being put into the backpack, which is easy to find and improves the convenience of use. When the aspiration member 10 needs to be used as the electronic cigarette, the aspiration member 10 can be directly disengaged from the bracelet member 30 for use, which further improves the convenience of use.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A portable aspiration device, comprising:

an aspiration member, comprising a socket; and a bracelet member, comprising:

a wristband;

a base, comprising a receiving room for receiving the aspiration member and an accommodating room in communication with the receiving room, wherein the wristband is fixed to the base and sleeve on a hand bowl to conveniently carry the aspiration member; and a locking structure accommodated in the accommodating room to lock the aspiration member, the locking structure comprising a locking portion, a resetting portion, and a switching portion;

wherein the locking portion is inserted into the socket to lock the aspiration member in the base, the switching portion is pressed to drive the locking portion to disengage from the socket so that the aspiration member may be taken out from the base, and the resetting portion is adapted to reset the locking portion and the switching portion.

2. The portable aspiration device as claimed in claim 1, wherein the locking portion comprises a locking element comprising a locking end and an accommodating end opposite to the locking end, and a fixing housing defining a locating groove, wherein the locking end is inserted into the socket to lock the aspiration member, and the accommodating end is partly received in the locating groove.

3. The portable aspiration device as claimed in claim 2, wherein the accommodating end defines an accommodating groove, the fixing housing comprises a first locating post and a first locating hole in communication with the locating groove, and the resetting portion comprises a first elastic element, wherein one end of the first elastic element is coiled around the first locating post, and another end of the first elastic element is received in the accommodating groove of the accommodating end through the first locating hole.

4. The portable aspiration device as claimed in claim 2, wherein the fixing housing comprises a second locating post and a second locating hole in communication with the locating groove, and the resetting portion comprises a second elastic element, wherein one end of the second elastic element is coiled around the second locating post, and another end of the second elastic element is received in the switching portion through the second locating hole.

5. The portable aspiration device as claimed in claim 4, wherein the switching portion comprises a button element comprising a button post and a receiving post, and a sliding pole comprising a hemisphere partially received in the receiving post, wherein the sliding pole is driven to move by pressing the button post, and the sliding pole drives the locking element to move, thereby realizing the aspiration member in an unlocking state.

6. The portable aspiration device as claimed in claim 5, wherein the locking element comprises a pair of first slanting parts, and the sliding pole comprises a pair of second slanting parts, wherein the second slanting parts is driven to move by pressing the button post, the second slanting parts drives the first slanting parts to move so that the locking portion disengages from the socket, and the aspiration member may be taken out from the base.

7. The portable aspiration device as claimed in claim 6, wherein the sliding pole comprises a sliding body and a receiving groove between the pair of second slanting parts, and the locking element comprises a locking body partly received in the receiving groove, wherein the first slanting parts extend from the accommodating end to the locking end.

8. The portable aspiration device as claimed in claim 7, wherein the locking body defines a pair of guiding grooves extending from the accommodating end to the locking end, the fixing housing comprises a pair of guiding blocks projecting from inner walls of the locating groove, wherein the guiding blocks may move along the guiding grooves respectively.

9. The portable aspiration device as claimed in claim 1, wherein the base comprises a waterproof seal ring fixed in inner wall of the receiving room, wherein when the aspiration member is received in the receiving room, the waterproof seal ring is in a compression state, when the aspiration member is disengaged from the receiving room, the waterproof seal ring is in a free state, during the aspiration member being disengaged from the receiving room, the waterproof seal ring provides resilience force to release the aspiration member from a locking state.

10. The portable aspiration device as claimed in claim 1, wherein the locking structure comprises a fixing portion comprising a pair of fixing posts, the base defines a pair of fixing holes for receiving the fixing posts to fix the locking structure in the base.

* * * * *